US012326314B2

(12) United States Patent
Vitulli

(10) Patent No.: US 12,326,314 B2
(45) Date of Patent: Jun. 10, 2025

(54) GUN MAGAZINE BASE PAD WITH CANTILEVER SPRING LATCH MECHANISM

(71) Applicant: Brandon Vitulli, Thomasville, GA (US)

(72) Inventor: Brandon Vitulli, Thomasville, GA (US)

( * ) Notice: Subject to any disclaimer, the term of this patent is extended or adjusted under 35 U.S.C. 154(b) by 0 days.

(21) Appl. No.: 18/143,822

(22) Filed: May 5, 2023

(65) Prior Publication Data

US 2024/0369316 A1 Nov. 7, 2024

(51) Int. Cl.
*F41A 9/70* (2006.01)

(52) U.S. Cl.
CPC ..... *F41A 9/70* (2013.01)

(58) Field of Classification Search
CPC ..... F41A 9/61; F41A 9/65; F41A 9/70; F41A 9/71; F41A 9/72
USPC ..... 42/50
See application file for complete search history.

(56) References Cited

U.S. PATENT DOCUMENTS 4,139,958 A * 2/1979 Foote ..... F41A 9/71 42/49.02
5,113,605 A * 5/1992 Kim ..... F41A 9/71 42/50
10,996,010 B2 * 5/2021 Cass ..... F41A 9/71
11,085,717 B1 * 8/2021 Hillis ..... F41A 9/71
2002/0029506 A1 * 3/2002 Wollmann ..... F41A 9/71 42/50
2008/0127539 A1 * 6/2008 Schaffer ..... F41A 9/65 89/33.1
2008/0190003 A1 * 8/2008 Bolen ..... F41A 9/61 42/50
2015/0316337 A1 * 11/2015 Alkhalaileh ..... F41A 9/65 42/6
2018/0347929 A1 * 12/2018 Hsu ..... F41A 9/71
2021/0231396 A1 * 7/2021 Brown ..... F41A 9/66
2023/0070228 A1 * 3/2023 Kellgren ..... F41A 9/65

* cited by examiner

*Primary Examiner* — Joshua E Freeman
*Assistant Examiner* — Benjamin S Gomberg
(74) *Attorney, Agent, or Firm* — J. Wiley Horton

(57) ABSTRACT

A firearm magazine base pad having a significantly reduced overall height. The base pad is slidably engaged to the bottom of the magazine tube-thereby securing a magazine spring and follower inside the tube. A plunger latch mechanism is provided to lock the base pad in place. The plunger can be depressed in order to release the base pad and allow it to slide free of the magazine tube. The plunger is biased upward by a lateral cantilever spring. A fixed end of the cantilever spring is attached to the base pad. A free end of the cantilever spring moves with the plunger.

15 Claims, 14 Drawing Sheets

GUN MAGAZINE BASE PAD WITH CANTILEVER SPRING LATCH MECHANISM

BACKGROUND OF THE INVENTION

1. Field of the Invention

This invention relates to the field of firearms. More specifically, the invention comprises a magazine base pad having a cantilever spring latch mechanism.

2. Description of the Related Art

The present invention is a base pad assembly suitable for use with a wide variety of firearm magazines. As will be apparent to those knowledgeable in the field, the designs disclosed herein can be modified and adapted in many forms. It is impossible to illustrate all these possibilities. Accordingly, only an exemplary version will be described in detail. This exemplary version is suitable for use with a magazine such as illustrated in FIGS. 1-5.

FIG. 1 provides an exploded view of some prior art magazine components. Tube 12 is a hollow structure designed to contain and feed cartridges to a firearm's firing chamber. Follower 16 translates vertically within the tube. The follower is urged upward by spring 18. In most designs, the follower and spring are fed into the tube through an opening in the bottom of the tube. These internal components are then captured within the tube via the addition of a base.

FIG. 2 shows a well-known design for a base (referred to as a "base pad" in this instance since it has a larger cross-section than the magazine tube and is intended to provide useful gripping features). Tube 12 incorporates a pair of laterally extending flanges 20—only one of which is visible in FIG. 2. Base pad 14 includes a pair of corresponding slots 22. Base pad 14 is attached to the rest of magazine assembly 10 by sliding slots 22 over lateral flanges 20. In this example the base pad is translated in the rearward direction. Front wall 23 eventually slides against the forward wall of tube 12 and arrests the further rearward translation of the base pad with respect to the tube.

At this point the magazine assembly is completed. The follower and spring are captured within the tube by the base pad. Of course, it is advisable to secure the base pad in this position so that it does not inadvertently come loose. Looking still at FIG. 2, plunger 24 is provided on the rear portion of base pad 14. The plunger is depressed during the installation of the base pad. Once the base pad reaches the installed position, the plunger pops up behind the rear wall of the magazine tube. In order to remove the base pad, the user must then depress the plunger.

FIGS. 3-5 provide additional details regarding the operation of plunger 24. FIG. 3 provides a rear elevation view with base pad 14 installed. The reader will note the position of the pair of slots 22 formed in side walls 26 of base pad 14. FIG. 3 shows how the two slots 22 slide closely over the laterally extending flanges 20 of the magazine tube. FIG. 3 also shows how plunger 24 has popped up behind the rear wall of tube 12. The base pad cannot be moved forward without pushing plunger 24 downward.

FIG. 4 provides a left side sectional elevation view through the assembly. Plunger slides vertically into well 34 within base pad 14. Plunger spring 36 is a compression spring that urges the plunger upward into the position shown. Angled surface 28 is provided on the top of the plunger. This angled surface causes the plunger to be cammed downward when the base pad is slid in the rearward direction during the installation process. The angled surface prevents the camming action when the base pad is urged forward from the installed position shown.

FIG. 5 provides greater detail in the vicinity of the plunger. Plunger 24 must be secured within well 34 so that it is not lost. It is also important to prevent the rotation of the plunger so that angled surface 28 is in the correct orientation. The correct orientation places high point 30 in the front and low point 32 in the rear.

A vertical slot 40 is provided in the rear portion of the plunger. A corresponding bore 44 is provided in the base pad. Spring cavity 38 is provided in the lower portion of plunger 24. During installation, the plunger and plunger spring 36 are oriented correctly and pushed down into well 34. Roll pin 42 is then pushed through bore 44 until the forward tip of the roll pin resides within slot 40. Slot 40 is a vertical slot that is only slightly wider than the diameter of the roll pin itself. It thus allows the plunger to travel up and down within the well, but does not allow the plunger to rotate.

FIG. 5 shows the plunger-based latch mechanism in its raised position. The interaction of roll pin 42 and slot 40 places low point 32 of plunger 24 just even with floor surface 31 of the base pad. The plunger is thus positioned to be cammed downward when the base pad is moved in the rearward direction along the lateral flanges of the magazine tube. In the example shown, roll pin 42 extends into slot 40. In other prior art examples slot 40 is actually a hole drilled through plunger 24. In that case roll pin 42 passes all the way through the hole and into a bore on the far side of well 34.

The latch mechanism shown in FIG. 5 is effective. However, those skilled in the art will perceive the accumulated overall height needed for this mechanism. A central purpose of the base pad is simply placing floor surface 31 across the open bottom of the magazine tube. The use of the latch mechanism illustrated in FIG. 5 causes the addition of height $h_1$ so that the base pad becomes relatively thick. It is desirable to create a latching mechanism that does not require this significant additional height.

BRIEF SUMMARY OF THE PRESENT INVENTION

The present invention comprises a magazine base pad having a significantly reduced overall height. The base pad is slidably engaged to the bottom of the magazine tube-thereby securing a magazine spring and follower inside the tube. A plunger latch mechanism is provided to lock the base pad in place. The plunger can be depressed in order to release the base pad and allow it to slide free of the magazine tube.

The plunger is biased upward by a lateral cantilever spring. A fixed end of the cantilever spring is attached to the base pad. A free end of the cantilever spring moves with the plunger. The cantilever spring resists the downward movement of the plunger-tending to move the plunger up toward the latched position. The use of the lateral cantilever spring significantly reduces the height of the base pad in comparison to the coil spring designs used in the prior art.

REFERENCE NUMERALS IN THE DRAWINGS

Figure 1:
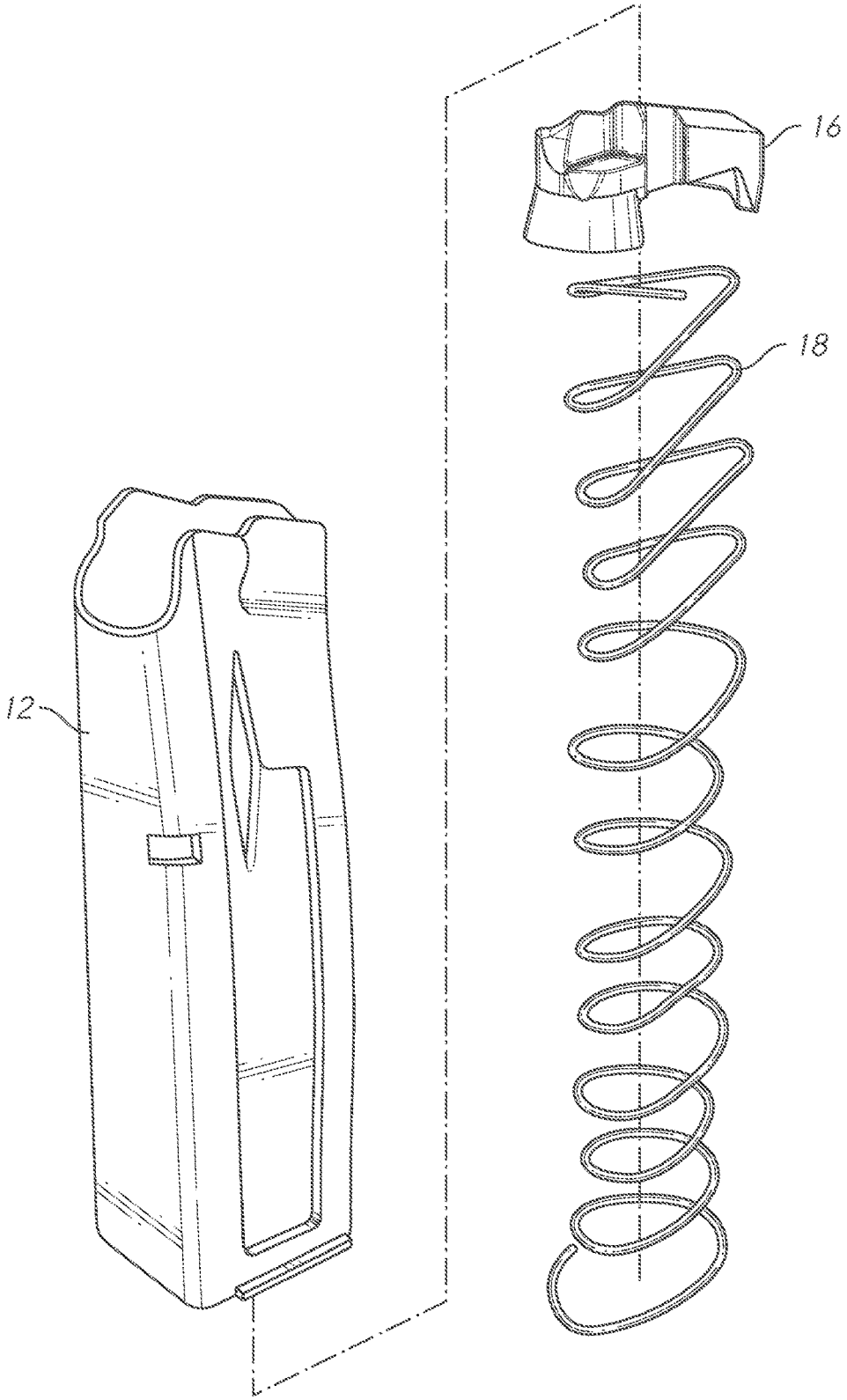
FIG. 1 (Prior Art)
FIG. 1 is an exploded perspective view, showing the tube, follower, and magazine spring of a prior art gun magazine.
Figure 2:
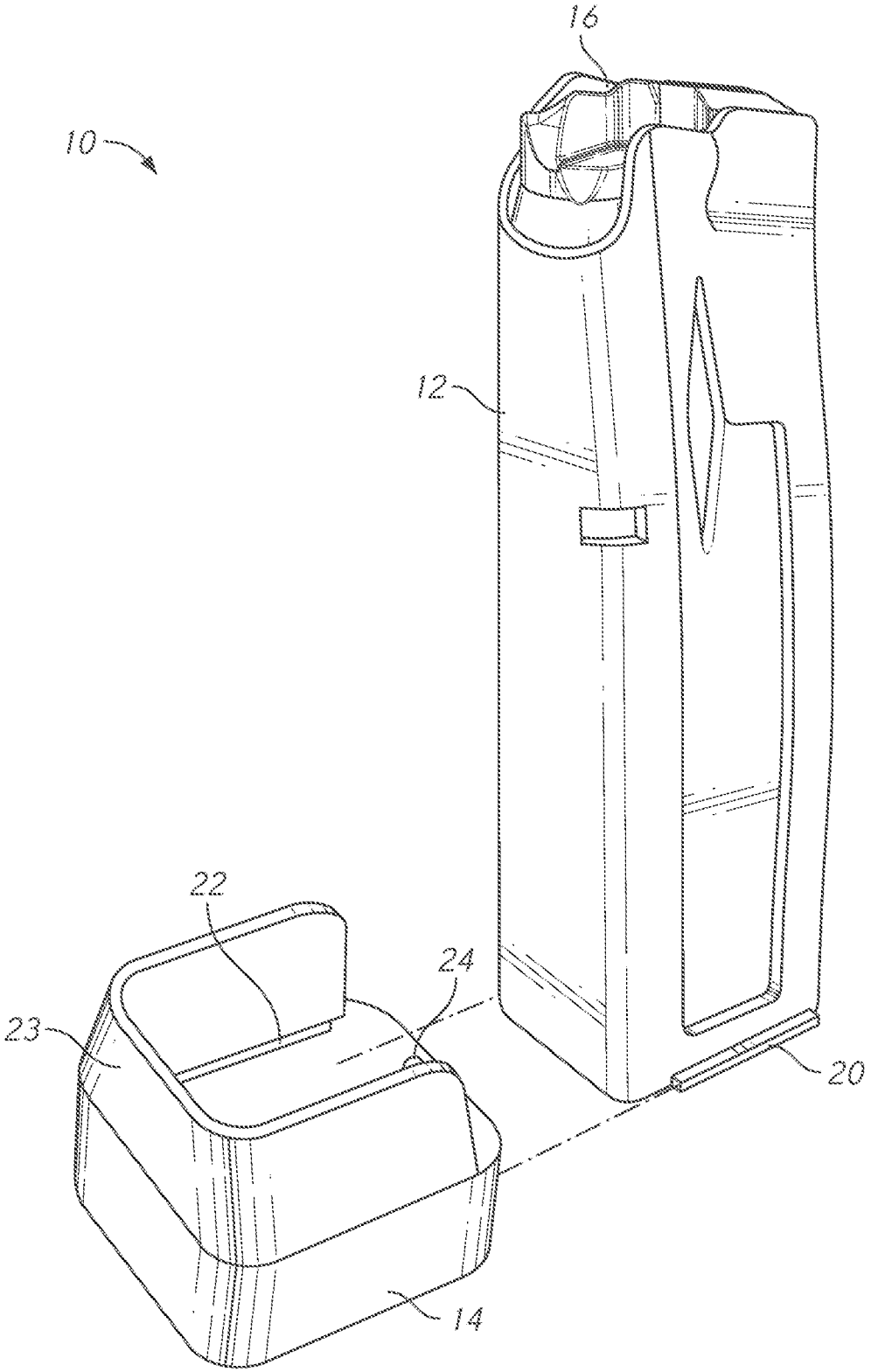
FIG. 2 (Prior Art)
FIG. 2 is an exploded perspective view, showing the addition of a base pad to the assembly of FIG. 2.
Figure 3:
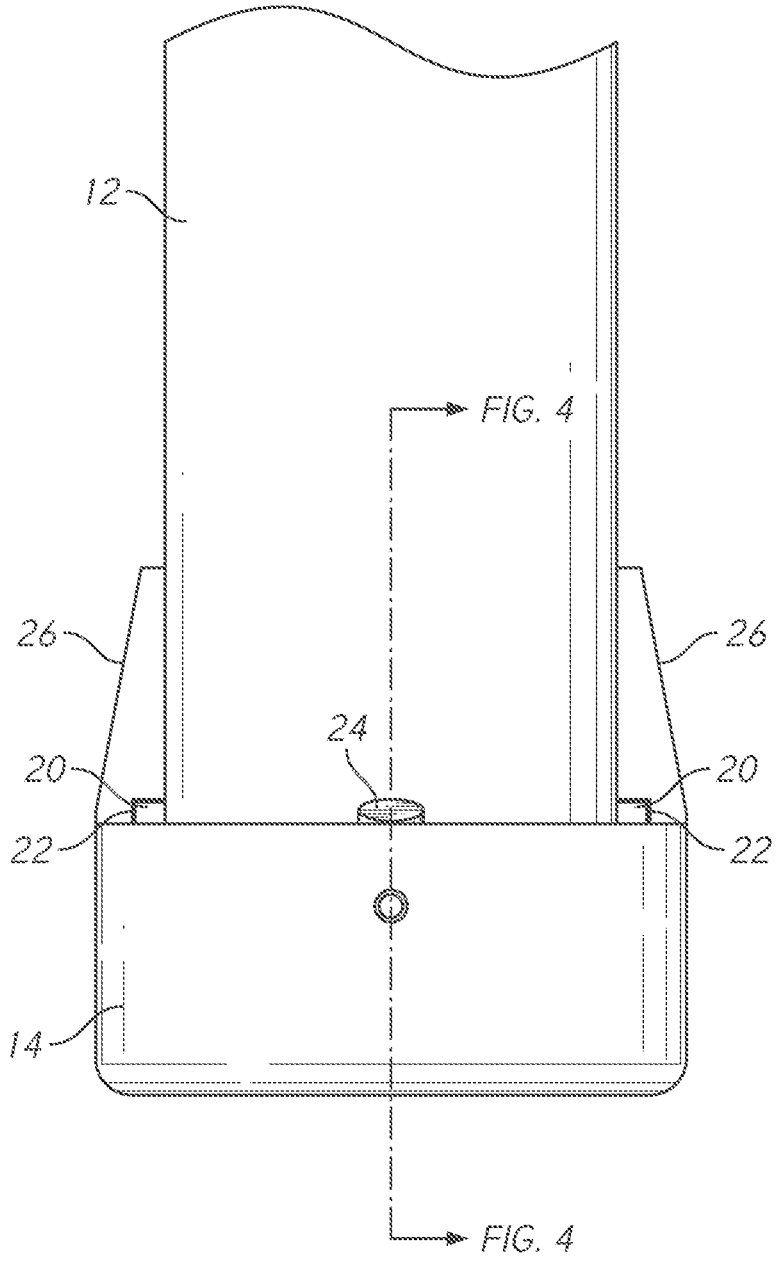
FIG. 3 (Prior Art)
FIG. 3 is a rear elevation view, showing a prior art base pad installed on a magazine tube.
Figure 4:
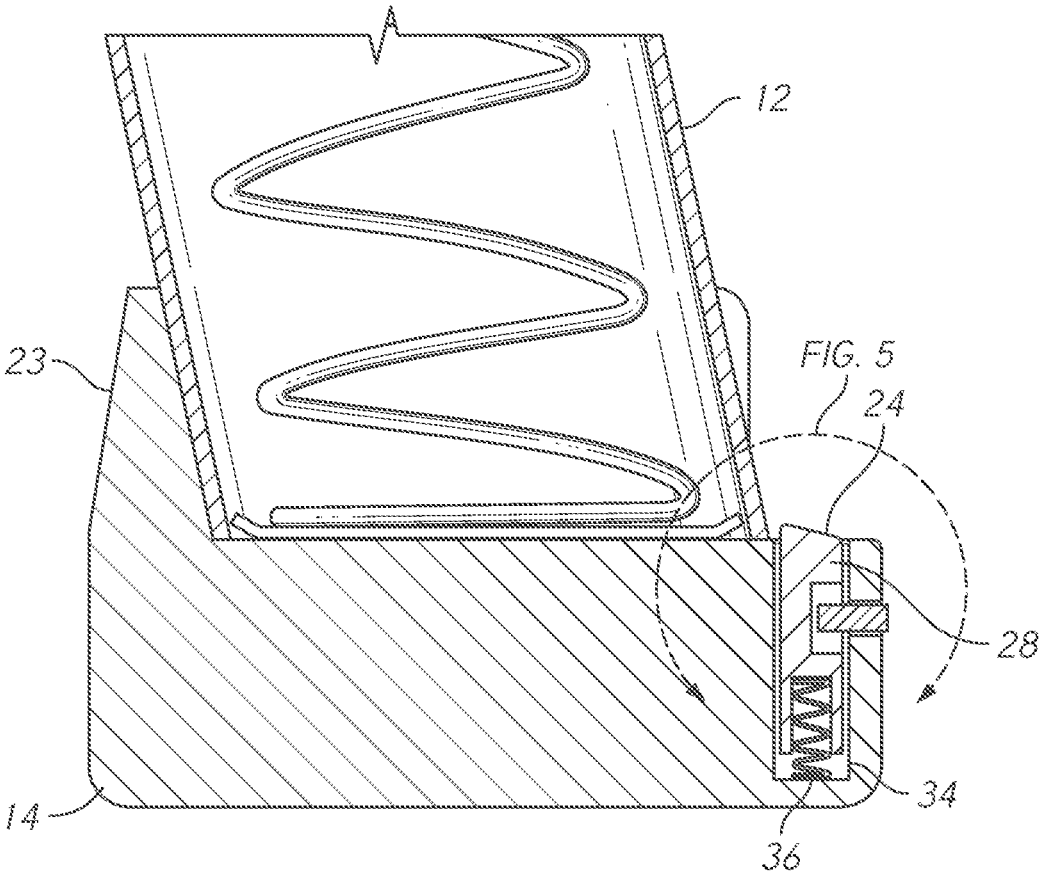
FIG. 4 (Prior Art)
FIG. 4 is a sectional elevation view, showing a prior art plunger latch mechanism on a magazine base pad.
Figure 5:
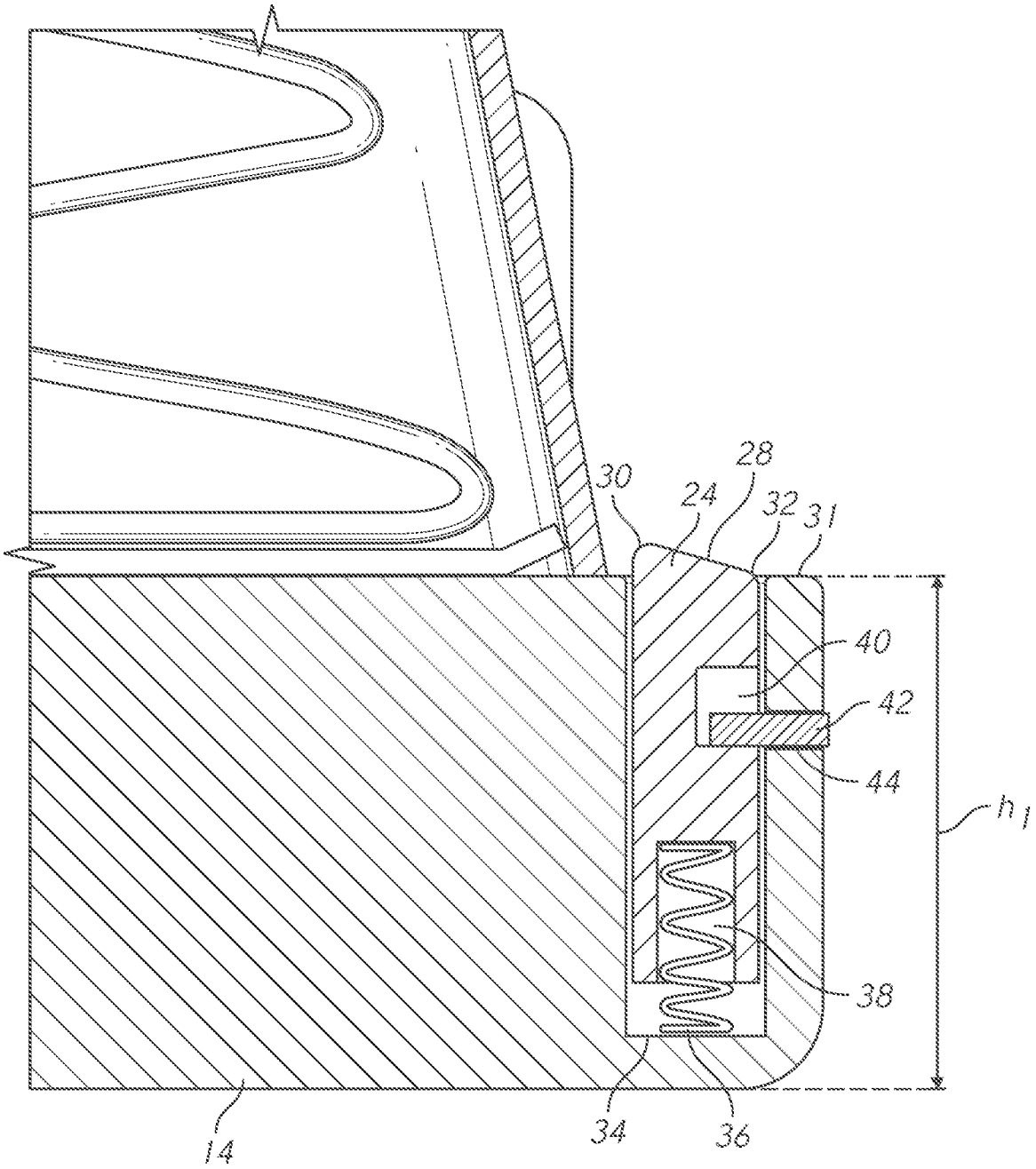
FIG. 5 (Prior Art)
FIG. 5 is a sectional elevation view, showing additional details of a prior art plunger latch mechanism.
Figure 6:
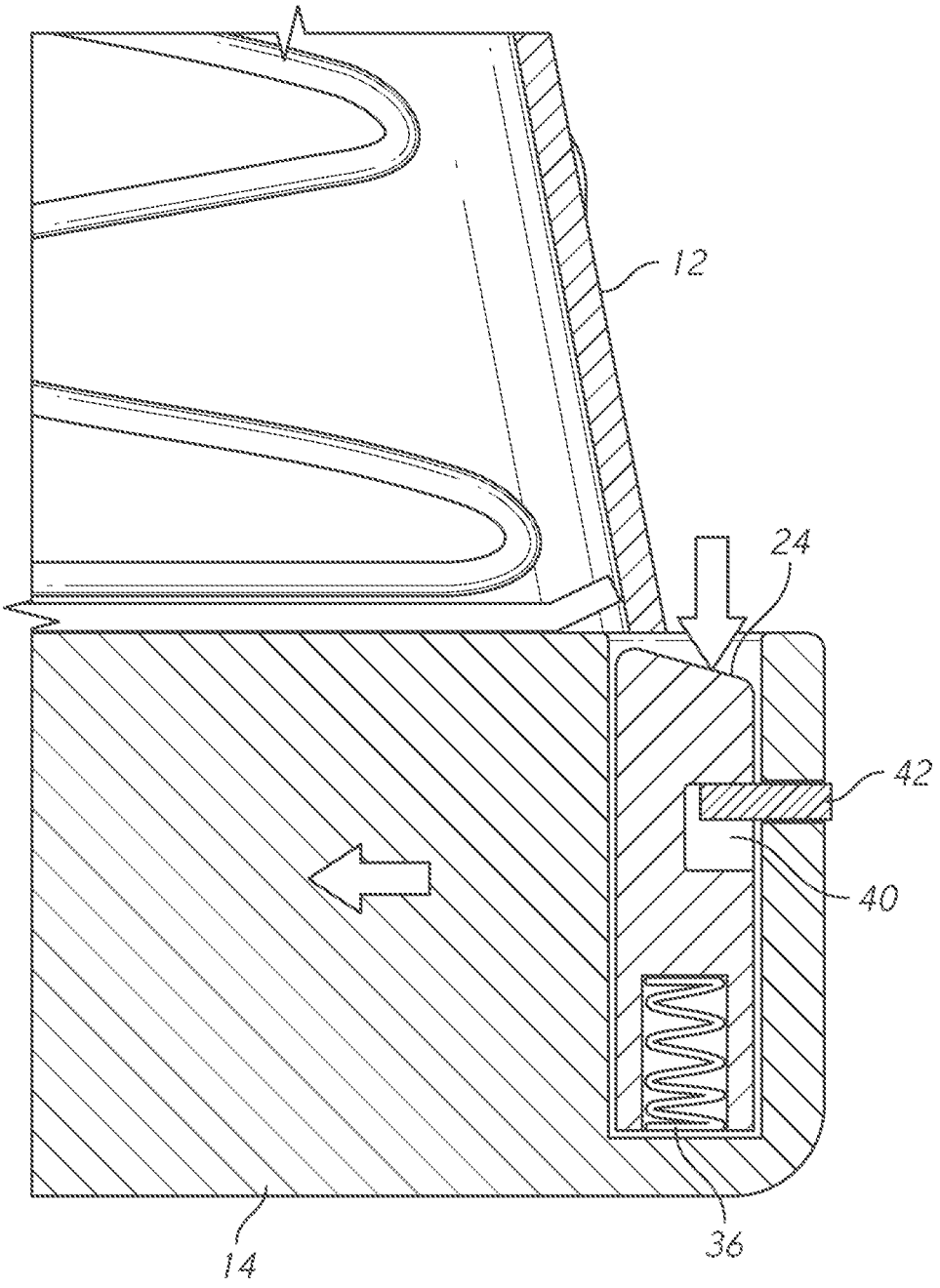
FIG. 6 (Prior Art)
FIG. 6 is a sectional elevation view, showing how the latch of FIG. 5 is released.

10 magazine assembly
12 tube
14 base pad
16 follower
18 spring
20 lateral flange
22 slot
23 front wall
24 plunger
26 side wall
28 angled surface
30 high point
31 floor surface
32 low point
34 well
36 plunger spring
38 spring cavity
40 slot
42 roll pin
44 bore
46 base pad
47 body
48 plunger
50 slot
52 large transverse bore
54 small transverse bore
56 cantilever spring
57 plunger bore
58 fixed end
60 free end
62 spring receiver
64 blind hole

DETAILED DESCRIPTION OF THE INVENTION

The following descriptions pertain to preferred embodiments of the present invention. Having reviewed these descriptions, many more embodiments will occur to those skilled in the art. As one example, many diverse approaches could be used to mount the fixed end of a cantilever spring. This disclosure describes only one of these. Accordingly, the scope of the invention should be set by the claims presented at the end of this disclosure rather than the embodiments described.

Figure 7:
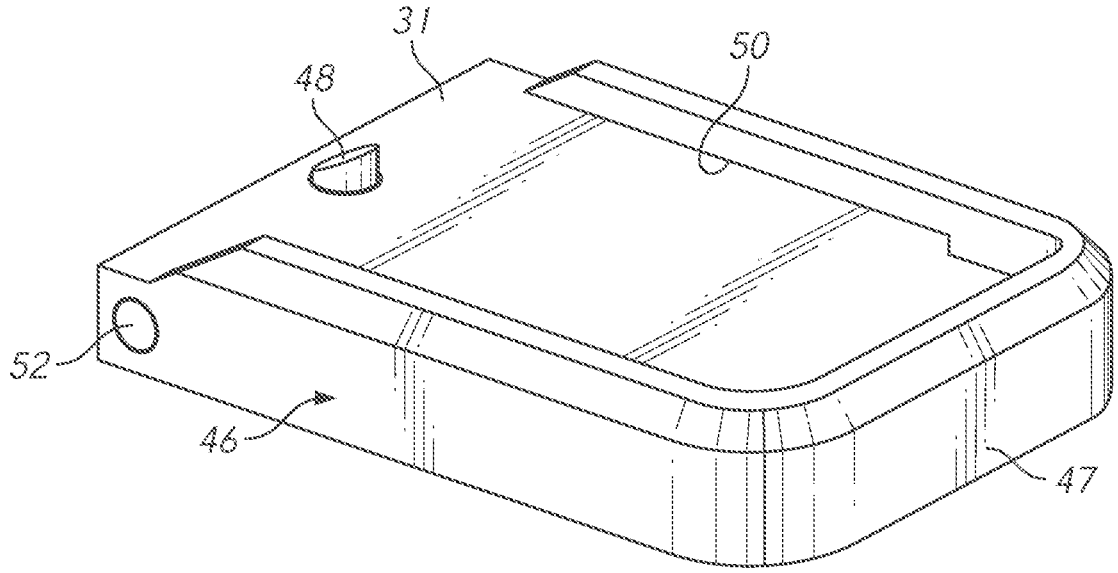
FIG. 7 is a perspective view, showing an embodiment of the inventive base pad.

An objective of the present invention is the provision of a latching arrangement similar to the one depicted in FIGS. 1-6, but without the increased height produced by the use of a plunger with a conventional coil spring mounted beneath. FIG. 7 shows an embodiment of the invention—designated as base pad 46. Body 47 includes floor surface 31, which is configured to close off the open bottom of the magazine tube. An elevated side wall runs around a first lateral side, the front, and the second lateral side of the body. A slot 50 is provided along each of the lateral sides.

Figure 8:
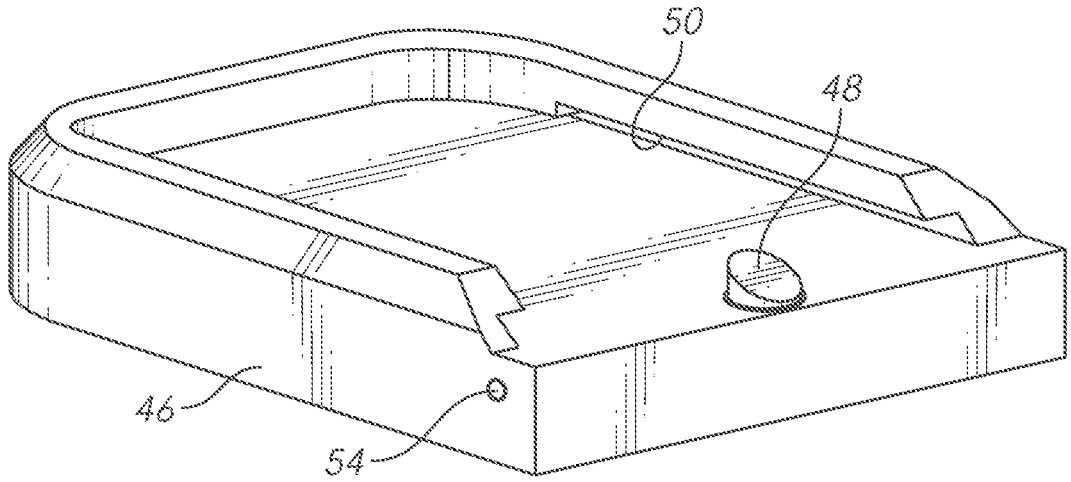
FIG. 8 is a perspective view, showing an embodiment of the inventive base pad.

Plunger 48 extends upward from the rear portion of floor surface 31—as for the prior art. Large transverse hole 52 extends laterally into body 47 as shown. FIG. 8 shows base pad 46 from the other side. The reader will note the presence of a second slot 50. Small transverse hole 54 extends into the body as shown. The two slots 50 in base pad 46 are sized and positioned to slidably engage the two lateral flanges 20 on the magazine tube. This allows the base pad to slide onto the bottom of the magazine tube as for the prior art.

Figure 9:
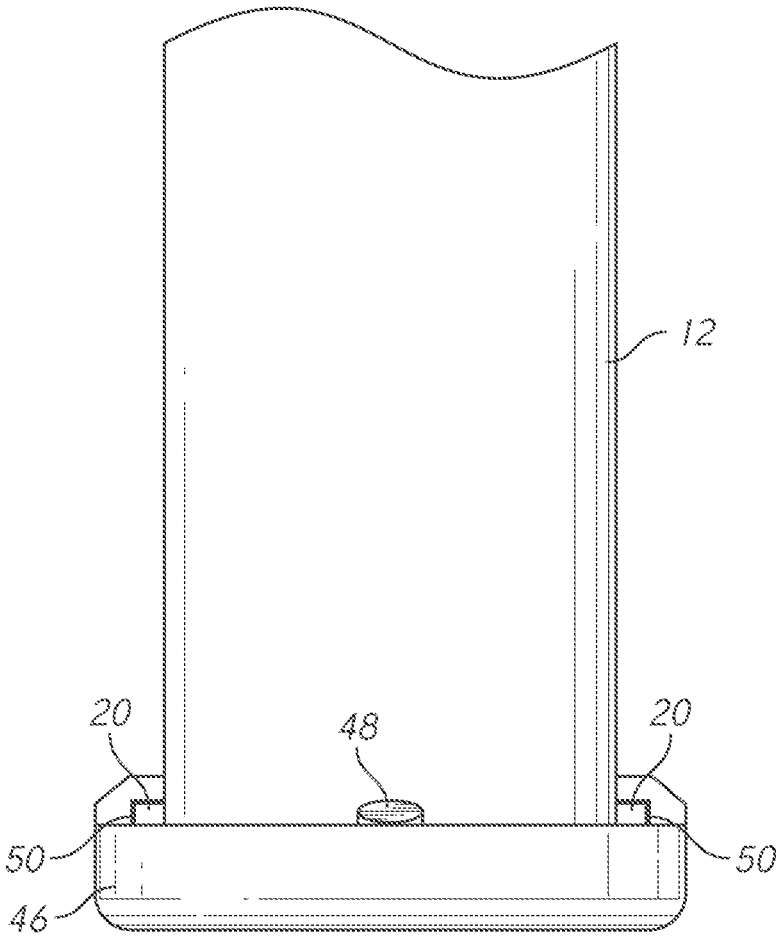
FIG. 9 is a rear elevation view, showing the inventive base pad installed on a magazine tube.

FIG. 9 shows a rear elevation view of base pad 46 slidably engaged to the bottom of tube 12. The reader will note how the base pad's two lateral slots 50 slide over the tube's lateral flanges 20. Plunger 48 extends out of the base pad and pops up behind the magazine tube-thereby preventing forward motion of the base pad relative to the tube unless plunger 48 is depressed.

Figure 10:
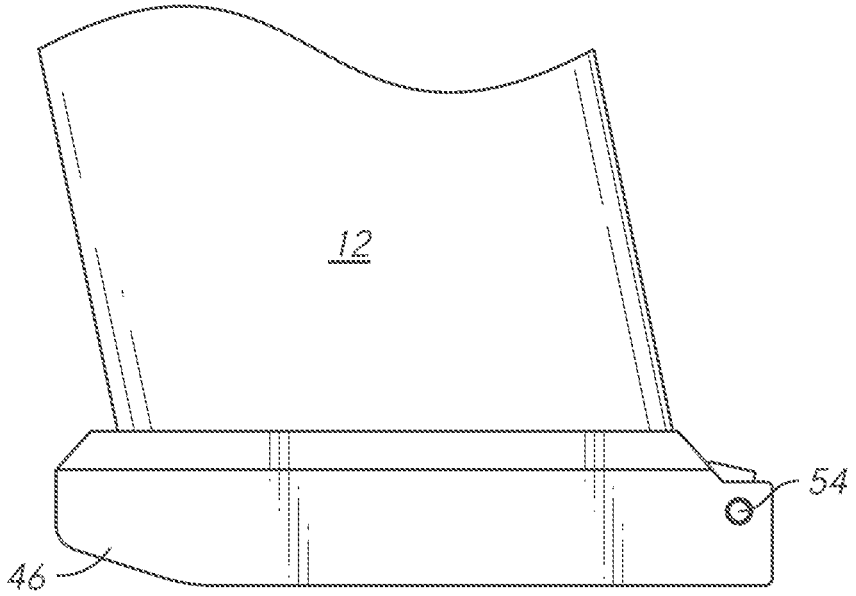
FIG. 10 is a right side elevation view, showing the inventive base pad installed on a magazine tube.
Figure 11:
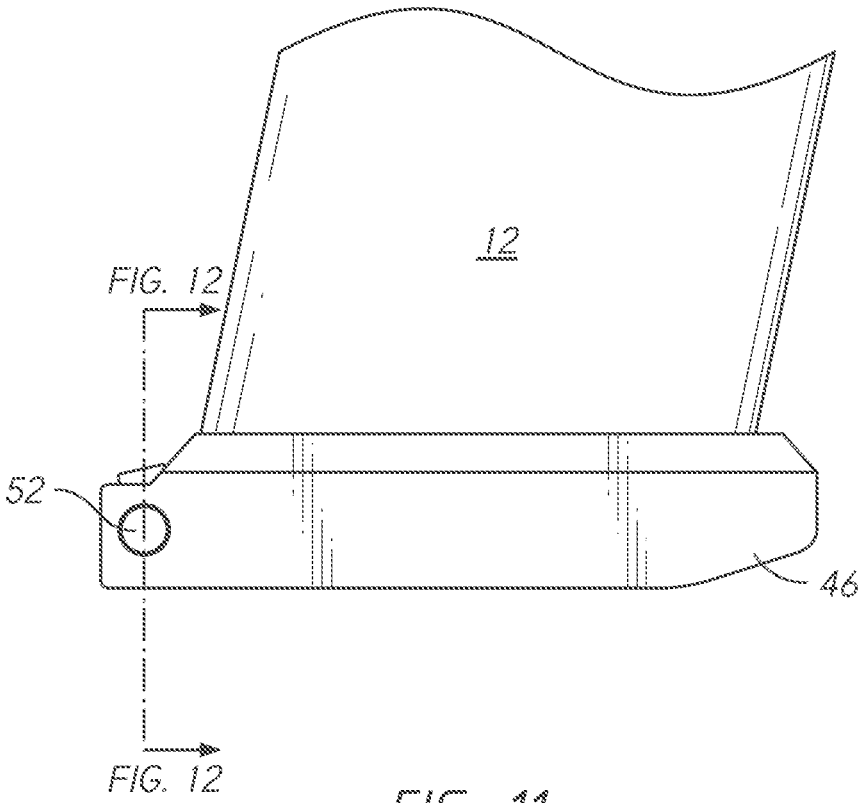
FIG. 11 is a left side elevation view, showing the inventive base pad installed on a magazine tube.

FIG. 10 shows a left side elevation view of the same assembly. Small transverse hole 54 is visible. FIG. 11 shows the corresponding right side elevation view. Large transverse hole 52 is visible.

In looking at FIGS. 7-10 the reader will note the significantly reduced height of base pad 46 in comparison to the prior art. This height reduction is achieved while still providing the same functionality for plunger 48. In order to explain how this is done, some internal details of the base pad must be explained. Looking at FIG. 11, the reader will note a section view "call out" for FIG. 12.

Figure 12:
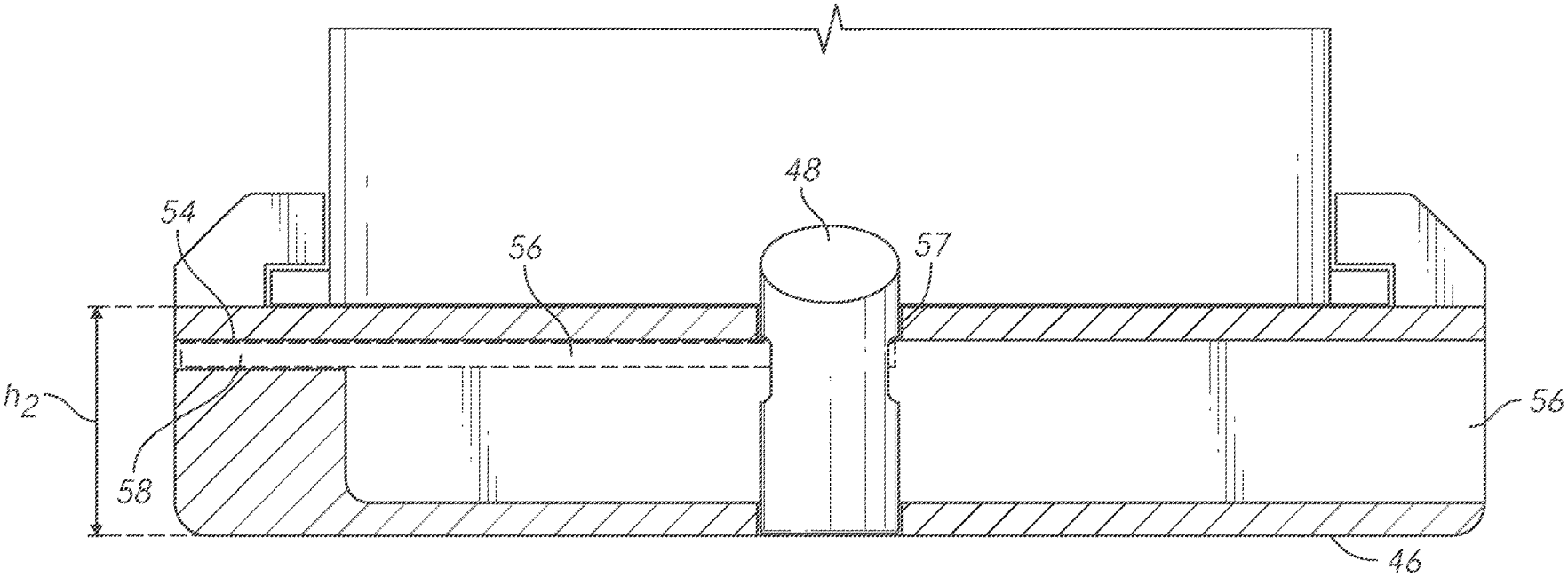
FIG. 12 is a rear sectional elevation view, showing the present invention with the cantilever spring in an undeflected state.

FIG. 12 provides a rear sectional elevation view through the middle of plunger 48 (though the plunger itself is not sectioned). For the plunger to operate as needed, a biasing spring is positioned to urge plunger 48 out of its corresponding bore 57 through the base pad. In the prior art this was done with a helical compression spring. In the present invention, cantilever spring 56 is used.

The cantilever spring can assume many forms. In the example of FIG. 12, the cantilever spring is a long and slender piece of spring steel having a circular cross section. The cantilever spring has a fixed end 58 and a free end. The fixed end is pressed into small transverse bore 54 so that it is held tightly. The free end of cantilever spring 56 is connected to plunger 48. Cantilever spring 56 therefore retains plunger 48 in the position shown-protruding from its corresponding bore 57.

Figure 13:
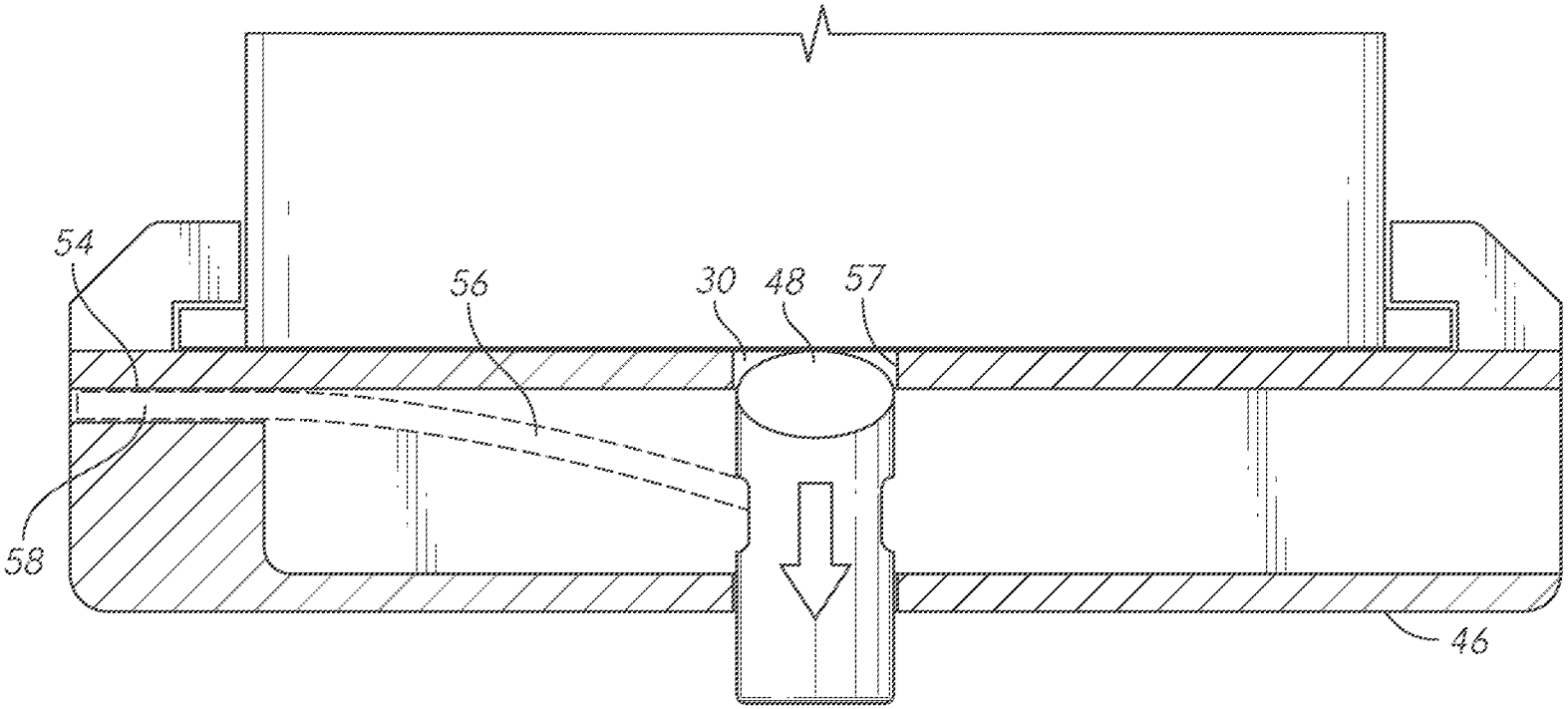
FIG. 13 is a rear sectional elevation view, showing the present invention with the cantilever spring in a deflected state.

FIG. 13 shows the same configuration after a pressing force has been used to push plunger 48 into its corresponding bore until high point 30 clears the bottom of the magazine well—the position needed to slide the base pad free of the magazine. Fixed end 58 of cantilever spring 56 is still held in position within small transverse bore 54. The unrestrained portion of the cantilever spring has elastically deformed as shown. Its free end has translated downward with plunger 48. If the depressing force on plunger 48 is removed, then cantilever spring 56 will return the plunger back to the position shown in FIG. 12.

In looking again at FIG. 12, the reader will appreciate how the use of the cantilever spring has allowed a much lower overall height $h_2$. The height of the base pad from the floor surface to the bottom of the base pad is in fact less than the overall height of the plunger itself. A much thinner base pad results.

Figure 14:
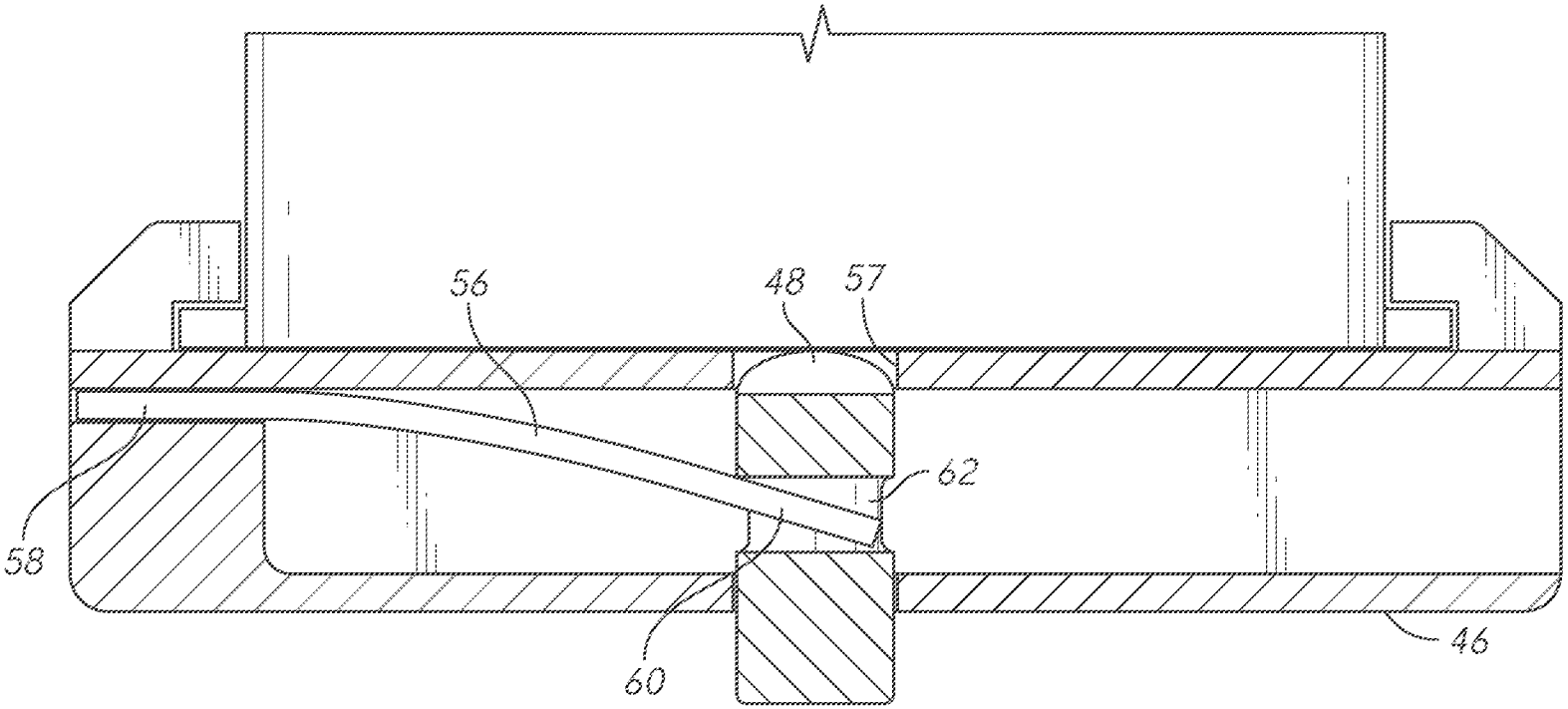
FIG. 14 is a rear sectional elevation view, showing an embodiment of a connection between the free end of the cantilever spring and a plunger.

The connection between the free end of the cantilever spring and the plunger can assume many forms. If a rigid connection is used, then the lower portion of the bore in which the plunger moves must be large enough to allow the plunger to pivot with the free end of the cantilever spring. Another option is to provide an elongated slot in the plunger so that the free end of the cantilever spring is free to pivot without requiring the plunger to pivot with it. This option is shown in FIG. 14. Spring receiver 62 is an elongated slot that passes transversely through plunger 48. Spring receiver 62 allows the free end 60 of cantilever spring 58 to pivot as shown-without forcing the plunger to pivot with it.

Figure 16:
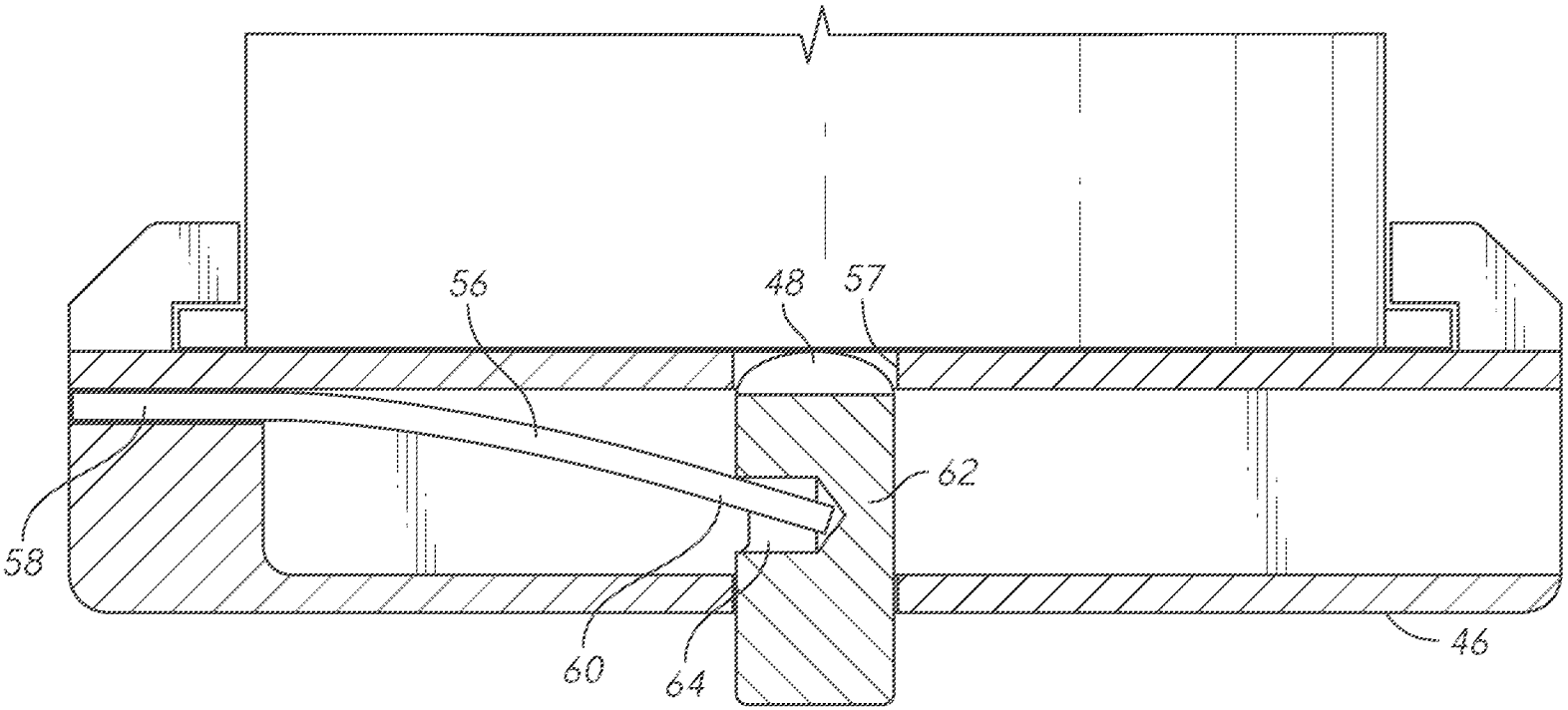
FIG. 16 is a rear sectional elevation view, showing another embodiment of a connection between the free end of the cantilever spring and a plunger.

FIG. 16 shows another embodiment of a spring receiver in plunger 48. In this example, blind hole 64 is provided in one side of the spring receiver. Free end 60 of cantilever spring 56 rests within the blind hole. This creates a stable engagement where the plunger is retained but able to move up and down within the plunger bore.

Figure 15:
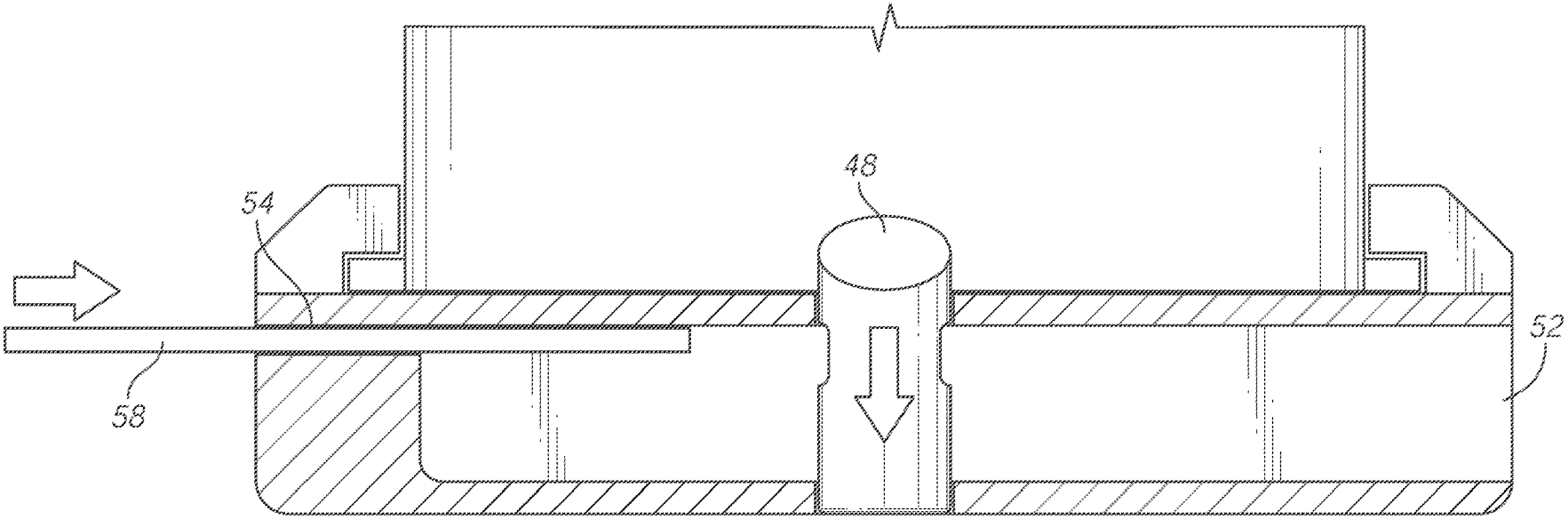
FIG. 15 is a rear sectional elevation view, showing an exemplary method of assembling the present invention.

FIG. 15 illustrates one method of assembling the embodiment of FIGS. 12-14. In this method plunger 48 is placed within its bore through the base pad and rotated so that the spring receiver 62 in plunger 48 aligns with small transverse bore 54 through the base pad. Cantilever spring 56 is then forced through small transverse bore 54 until the free end of the cantilever spring passes through spring receiver 62 and thereby connects the cantilever spring to the plunger. The plunger is retained within its bore via the cantilever spring being engaged with spring receiver 62. The cantilever spring 56 is retained within small transverse bore 54 via friction (It is a press fit). An adhesive can also be used to create or enhance the engagement between the fixed end of the cantilever spring and small transverse bore 54. It is also possible to secure the fixed end of the cantilever spring using a roll pin, a set screw, a threaded engagement, or other suitable components. An additional fixation component is advantageous when the cantilever spring is a more complex shape—such as a flat spring.

In this disclosure, the term "cantilever spring" should be broadly understood to mean any elastically deformable element having a fixed end and a free end. Though the cantilever spring in the example shown is transverse to the orientation of the plunger, this does not have to be the case. The spring can assume an angled position and still work. Likewise, though the exemplary cantilever spring is made of spring steel, many other materials could be substituted.

Base pad 46 and plunger 48 can likewise be made of metal, polymer, or any other desirable material. In the preferred embodiments these components are made of metal-such as aluminum. Those skilled in the art will realize that the geometry of the base pad limits itself to a molding process-such as meal injection molding.

Many other variation are possible, many of which can be combined. Examples include:

1. A cantilever spring with a non-circular cross-section, such as a rectangular cross section found in most leaf springs;
2. A threaded connection for the fixed end of the cantilever spring;
3. A connection between the fixed end of the cantilever spring and the body of the base pad that is made by an overmolding process;
4. A cantilever spring on two lateral sides of the plunger; and
5. A reversed arrangement for the base pad and the magazine—where the plunger is placed on the front of the base pad and the base pad slides off the magazine in a rearward direction.

The invention thus disclosed offers significant advantages over the prior art. These include:

1. A lower overall height, as described in detail previously;
2. The base pad will most often rest in an installed state (on the magazine tube). In this state the cantilever spring of the present invention is relaxed. In the installed state for the prior art, the helical compression spring is compressed. The present invention thereby should obtain increased spring life; and
3. The cantilever spring arrangement is tolerant of fouling debris-such as dirt or sand. In contrast, the prior art helical spring arrangement is more easily jammed.

Although the preceding descriptions contain significant detail, they should not be construed as limiting the scope of the invention but rather as providing illustrations of the preferred embodiments of the invention. Those skilled in the art will know that many other variations are possible without departing from the scope of the invention. Accordingly, the scope of the invention should properly be determined with respect to the following claims rather than the examples given.

Having described my invention, I claim:

1. A base pad configured to be slidably attached to a tube, comprising:

(a) a body with a front, a first lateral side, a second lateral side, a back, and a floor;
(b) said body opening into a vertically-oriented plunger bore;
(c) a plunger slidably mounted within said plunger bore so that said plunger moves up and down within said plunger bore;
(d) a horizontally-oriented cantilever spring having a fixed end and a free end;
(e) said fixed end of said cantilever spring being connected to said base pad;
(f) said free end of said cantilever spring being connected to said plunger so that said free end moves vertically with said motion of said plunger; and
(g) said cantilever spring urging said plunger upward so that said plunger protrudes out of said bore and inhibits motion between said body and said tube.

2. The base pad as recited in claim 1, wherein said cantilever spring extends from said first lateral side of said body toward said second lateral side of said body.

3. The base pad as recited in claim 1, wherein:
(a) said plunger includes a transverse spring receiver; and
(b) said free end of said cantilever spring rests within said transverse spring receiver in said plunger.

4. The base pad as recited in claim 1, wherein:
(a) said body includes a transverse bore extending from said first lateral side toward said second lateral side;
(b) said fixed end of said cantilever spring is pressed into said transverse bore so that said fixed end is frictionally secured by said transverse bore.

5. The base pad as recited in claim 1, wherein said cantilever spring is made of spring steel.

6. A base pad for a gun magazine tube, comprising:
(a) a body configured to slidably engage said magazine tube and close off an open bottom of said magazine tube;
(b) said body including a vertically-oriented plunger bore;
(c) a plunger slidably mounted within said plunger bore, said plunger being movable between a raised position that inhibits motion between said body and said magazine tube and a lowered position that allows motion between said body and said magazine tube;
(d) a cantilever spring having a first end and a second end;
(e) said first end of said cantilever spring being attached to said base pad in a manner that resists translation and rotation;
(f) said second end of said cantilever spring being connected to said plunger so that said second end moves vertically with said motion of said plunger; and
(g) said cantilever spring urging said plunger upward toward said raised position.

7. The base pad as recited in claim 6, wherein:
(a) said body has a front, a first lateral side, a second lateral side, and a back; and
(b) said cantilever spring extends from said first lateral side of said body toward said second lateral side of said body.

8. The base pad as recited in claim 6, wherein:
(a) said plunger includes a transverse spring receiver; and
(b) said second end of said cantilever spring rests within said spring receiver in said plunger.

9. The base pad as recited in claim 6, wherein:
(a) said body includes a first lateral side and a second lateral side;
(b) said body includes a transverse bore extending from said first lateral side toward said second lateral side; and
(c) said first end of said cantilever spring is pressed into said transverse bore so that said first end is frictionally secured by said transverse bore.

10. The base pad as recited in claim 6, wherein said cantilever spring is made of spring steel.

11. A gun magazine assembly, comprising:
(a) a magazine tube, having walls and an open bottom;
(b) a base pad with a body configured to slidably engage said magazine tube proximate said open bottom, with said body closing said open bottom when slidably engaged to said magazine tube, said body including a vertically-oriented plunger bore;
(c) a plunger slidably mounted within said plunger bore, said plunger being movable between a raised position that inhibits motion between said body and said magazine tube and a lowered position that allows motion between said body and said magazine tube;
(d) a horizontally-oriented cantilever spring having a first end and a second end;
(e) said first end of said cantilever spring being attached to said body;
(f) said second end of said cantilever spring being connected to said plunger; and
(g) said cantilever spring urging said plunger upward toward said raised position.

12. The gun magazine assembly as recited in claim 11, wherein:
(a) said body has a front, a first lateral side, a second lateral side, and a back; and
(b) said cantilever spring extends from said first lateral side of said body toward said second lateral side of said body.

13. The gun magazine assembly as recited in claim 12, wherein:
(a) said body includes a transverse bore extending from said first lateral side toward said second lateral side;
(b) said first end of said cantilever spring is pressed into said transverse bore so that said first end is frictionally secured by said transverse bore.

14. The gun magazine assembly as recited in claim 11, wherein:
(a) said plunger includes a transverse spring receiver; and
(b) said second end of said cantilever spring rests within said spring receiver in said plunger.

15. The gun magazine assembly as recited in claim 11, wherein said cantilever spring is made of spring steel.

* * * * *